United States Patent [19]

Suzuki et al.

[11] Patent Number: 4,669,230

[45] Date of Patent: Jun. 2, 1987

[54] WET BLASTING MACHINE WITH AUTOMATIC CONTROL SYSTEM FOR SLURRY CONCENTRATION

[75] Inventors: Hidemasa Suzuki; Mitsuru Watanabe; Matsuo Ohtake, all of Shizuoka, Japan

[73] Assignee: Fuji Seiki Machine Works, Ltd., Shizuoka, Japan

[21] Appl. No.: 815,890

[22] Filed: Jan. 3, 1986

[51] Int. Cl.[4] ..... B24C 3/00; B24C 7/00

[52] U.S. Cl. ..... 51/415; 51/410; 51/437; 51/319; 73/32 R

[58] Field of Search ..... 51/415, 416, 410, 424, 51/438, 425, 437, 436, 426, 427, 317, 319, 263; 73/433, 434, 32 R

[56] References Cited

U.S. PATENT DOCUMENTS

| | | | |
|---|---|---|---|
| 2,463,159 | 3/1949 | Dietert | 73/32 |
| 4,319,435 | 3/1982 | Suzuki | 51/436 |
| 4,330,968 | 5/1982 | Kobayashi | 51/436 |
| 4,517,774 | 5/1985 | Pudding | 51/319 |
| 4,614,100 | 9/1986 | Green | 51/415 |

*Primary Examiner*—Frederick R. Schmidt
*Assistant Examiner*—Bradley I. Vaught
*Attorney, Agent, or Firm*—Flynn, Thiel, Boutell & Tanis

[57] ABSTRACT

A wet blasting machine having a blasting apparatus wherein slurry is supplied from a main hopper through a supply conduit to a blasting gun. Slurry can be bled from the supply conduit through a control valve into a vessel for collecting a predetermined volume of slurry. The weight of the vessel is measured to generate a first signal which represents the slurry weight, and hence the slurry concentration. The first signal is compared to a second preset signal which represents the desired slurry concentration. If the second signal indicates that the slurry concentration in the main hopper is less than the desired magnitude, then the comparator emits an output signal which activates a supply device for adding additional media to the main hopper. The supply device preferably includes a mixing hopper to which both dry media and slurry from the main hopper are initially fed and mixed, prior to the enriched slurry then being fed into the main hopper.

13 Claims, 4 Drawing Figures

WET BLASTING MACHINE WITH AUTOMATIC CONTROL SYSTEM FOR SLURRY CONCENTRATION

FIELD OF THE INVENTION

This invention relates to a wet blasting machine having an automatic control system for controlling the concentration of the slurry as supplied to the blasting gun.

BACKGROUND OF THE INVENTION

In the development of the wet blasting method and with the automation of such method, one of the desired requirements of such method is the ability to repetitively finish a series of parts by blasting while ensuring that the blasting is maintained with the same degree of uniformity or equality so as to ensure that the process can be repeated with uniformity and consistency. To achieve this objective, the ratio of water and abrasive particles, that is, the concentration of the slurry, should be maintained within a predetermined range.

To provide a machine which attempts to meet the above objectives, the assignee of this invention has developed a machine which attempts to maintain the slurry concentration, such machine being illustrated by Japanese Pat. No. 55-8311. This prior machine, which is schematically illustrated in FIG. 2 hereof, has a device D for detecting the slurry concentration within the slurry supply line which connects the slurry supply hopper $a_1$ with the slurry blasting gun $a_2$. Depending upon the result of the measurement by this device D, the fluid control valve G which is provided in the pipe F automatically operates and supplies liquid from the top layer of the slurry settling tank E to the outlet $a_4$ of the slurry supply hopper $a_1$. In this manner, an attempt is made to prevent the slurry from becoming too heavy so as to keep the slurry concentration in a prescribed range as the slurry is supplied by the pump $P_1$ to the blasting nozzle. This arrangement also facilitates the start of the machine, but is not capable of maintaining slurry concentration within a more desirable range when the slurry becomes light in weight.

One of the primary problems associated with controlling the slurry concentration is the difficulty in measuring the content of the abrasive particles within the water as the slurry is supplied to the blasting gun. Generally, the measurement of the slurry concentration can not be optimally performed by installation of measuring tools within the flow line inasmuch as the slurry contains the abrasive particles. If the viscosity of the slurry is equal or substantially equal to that of water, and the flow rate of the slurry is constant, then the concentration of the slurry can be obtained by measuring the dynamic flow pressure of the slurry. In this case, however, the abrasive nature of the slurry and its flow through the pipe to the blasting gun causes substantial fluctuations and changes according to whether the gun is operating or not, so that measurement of dynamic pressure of flow is extremely difficult.

In an attempt to avoid the above problem, another method attempts to detect slurry concentration from outside the pipeline. In this measuring method, such as disclosed in the assignee's aforementioned patent, a measuring apparatus which is either supersonic or which involves use of an electro-magnetic flow meter is involved. Although such devices have a stabilized function, nevertheless these devices are of a complicated structure and such devices are also expensive.

Accordingly, it is an object of this invention to provide a slurry concentration measuring arrangement for use with a wet blasting apparatus, which measuring apparatus overcomes the defects and disadvantages noted above. More specifically, this invention provides an automatic slurry concentration measurement which is not affected by the flow rate of the slurry or the abrasive nature thereof, and which possesses a simple structure and provides consistent results.

In the improved wet blasting machine of this invention, there is provided a slurry concentration control device involving a vessel for holding a given volume of slurry, and a bleed line is connected between the vessel and the main slurry supply line as connected to the blasting gun. The bleed line permits filling of the vessel with slurry, and a measuring device is associated with the vessel to create an electrical signal which is a function of the weight of slurry in the vessel. This signal representing the measured quantity of slurry is compared to a predetermined signal which represents the desired slurry concentration. If the measured value indicates that the actual concentration is less than the desired amount, then a signal activates an abrasive make-up system so that some slurry is withdrawn from the main tank into a make-up tank, and additional abrasive is supplied to this make-up tank for mixing with the slurry therein. A time-delayed valve is then opened so that the concentrated slurry in the make-up tank is supplied to the main tank so as to increase the concentration of the abrasive particles therein.

Other objects and purposes of the invention will be apparent to persons familiar with systems of this general type upon reading the following specification and inspecting the accompanying drawings.

DETAILED DESCRIPTION

Figure 1:
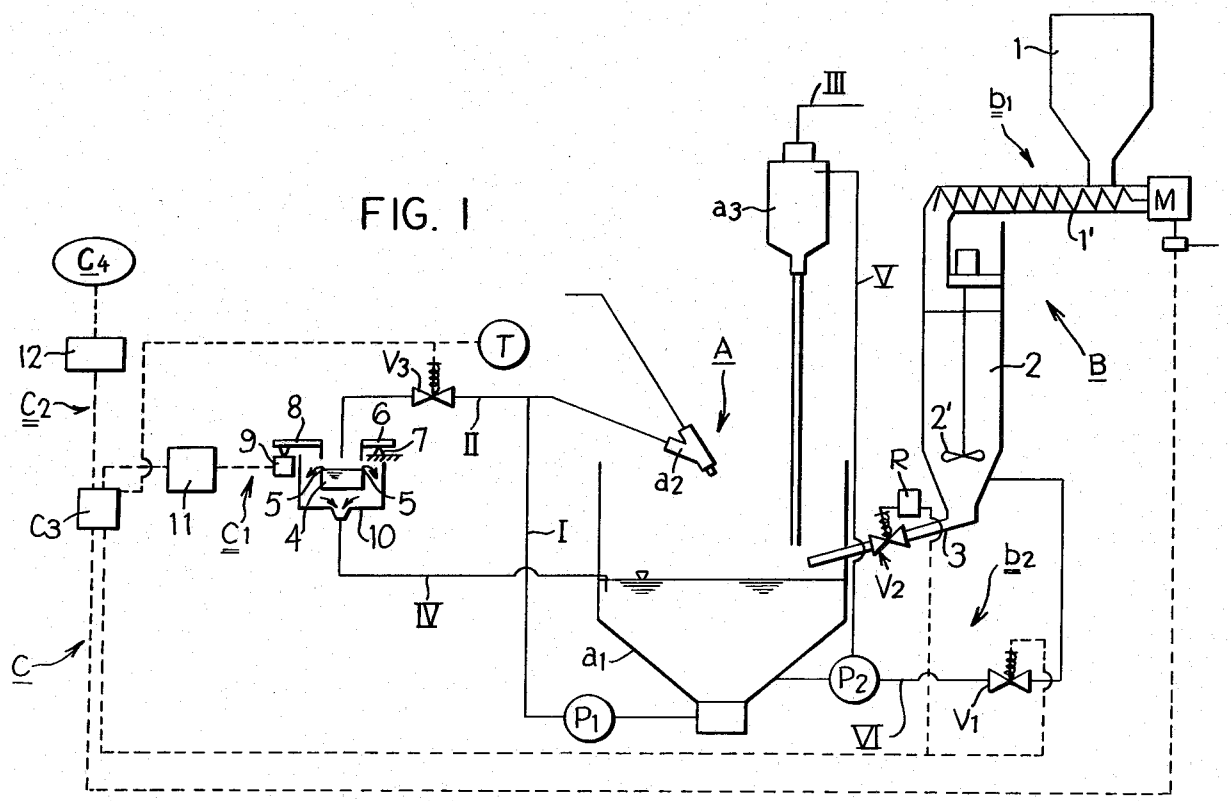
FIG. 1 is a flow diagram illustrating a wet blasting machine according to the present invention as incorporating therein the automatic control device for slurry concentration.
Figure 2:
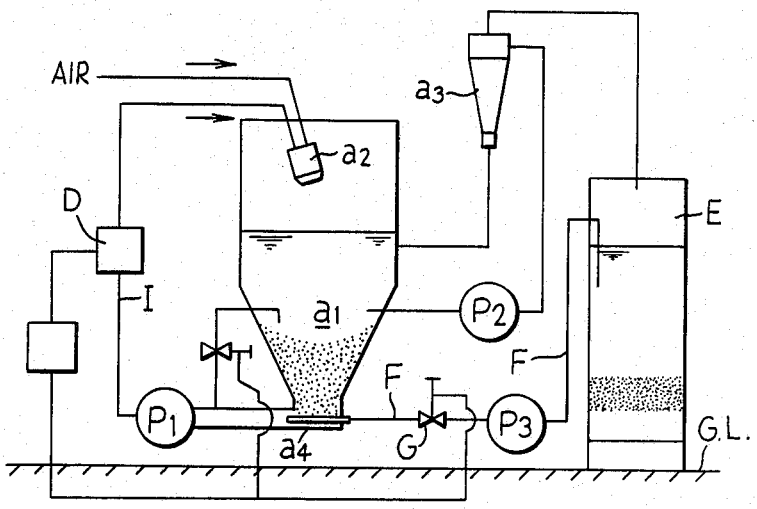
FIG. 2 PRIOR ART
FIG. 2 is a diagram illustrating an existing wet blasting machine provided with a slurry concentration measuring device associated therewith.

Referring to FIG. 1, there is illustrated an embodiment of the invention wherein a wet blasting machine incorporates therein means for automatically controlling slurry concentration.

The wet blasting apparatus A involves a main tank or hopper $a_1$ containing therein a slurry (i.e., a mixture of water and abrasive particles). The slurry is withdrawn from the bottom of the main tank by a pump $P_1$ and supplied through a main supply line I to a blasting gun $a_2$ which ejects a jet of slurry against a workpiece which is to be finished. The slurry ejected from the gun is again resupplied back into the main tank. Part of the slurry in the main tank or hopper is sent by a pump $P_2$ through the line V to a hydrocyclone $a_3$ which, in a conventional manner, effects separation of the nonusable or fractured particles so that they are discharged through the line III, with the usable particles being discharged from the lower end of the hydrocyclone so as to be resupplied back to the main hopper $a_1$. This arrangement A, as described above, defines the basic wet blasting system.

There is additionally provided a blasting media supply arrangement B used for supplying additional blasting media (i.e., abrasive particles) to the slurry contained within the main hopper $a_1$. This blasting media supply arrangement B includes a supply device $b_1$ having a storage tank or hopper 1 containing therein the abrasive media, the lower discharge end of which communicates with a conveyor screw 1' driven by a motor M. This conveyor screw 1' delivers the blasting media into the upper end of a make-up or mixing tank 2, the latter having a rotatable stirring device 2' disposed in the interior thereof. The outlet 3 from the make-up tank 2 communicates with the interior of the main hopper $a_1$.

The supply apparatus B also includes a control arrangement $b_2$ for controlling the supply of additional blasting media from the make-up tank 2 to the main hopper $a_1$. This control arrangement $b_2$ includes a normally closed valve $V_2$ associated with the outlet 3, the valve $V_2$ normally being of the electrical or magnetic type. This valve $V_2$ has a time-delay relay R associated therewith. In addition, a line VI extends from the pump $P_2$ to the make-up tank 2 for permitting some of the slurry within the main hopper $a_1$ to be supplied to the make-up tank 2 for addition of further abrasive particles thereto. This line VI has a normally closed valve $V_1$ associated therewith, the latter also being preferably electrically or magnetically controlled.

To control and maintain the concentration of the slurry supplied from the main hopper $a_1$ to the gun $a_2$, the overall system is provided with a slurry concentration control device C associated therewith.

This control device C includes a slurry weight measuring means $C_1$ which includes a vessel 4 capable of holding a given volume of slurry, this vessel 4 being supplied with slurry through a bleed line II which is connected to the main slurry supply line I. The bleed line II has a normally closed valve $V_3$ associated therewith, the latter preferably being electrically or magnetically actuated. The valve $V_3$ is additionally coupled to a timer T which maintains the valve $V_3$ open for only a predetermined period of time. The slurry weight measuring means $C_1$ generates a signal, preferably an electrical signal, which is indicative of the weight of slurry contained in the measuring vessel 4. For this purpose, the vessel 4 is supported by two arms, the one arm 6 being supported on a stationary knife edge 7, and the other arm 8 being supported on and in contact with a conventional load cell 9. The arms 6 and 8 project in diametrically opposite directions from the vessel so that, when the vessel is filled with slurry, the load cell 9 generates an electrical signal which indicates the weight of the slurry in the vessel.

The vessel 4 has overflow outlets 5 at the upper edge thereof so that excess slurry will flow out of the vessel into a surrounding collection housing 10, from which the overflow then flows through the return line IV back to the main hopper $a_1$.

The electrical signal from the load cell 9 is sent, via the amplifier 11, to a comparator $C_3$.

The comparator $C_3$ compares the electric signal received from the load cell 9 with a base signal received from an electric device $C_2$, the measured signal from the load cell hereinafter being referred to as the $C_1$ signal, and the base signal from the device $C_2$ hereinafter being referred to the $C_2$ signal for convenience in reference.

The base signal (or voltage) $C_2$ is determined by means of a setting device $C_4$ which is initially adjusted to determine a base signal value which represents the desired slurry concentration. The base signal $C_2$ from this setting device $C_4$ is delivered to the comparator $C_3$ via a conventional digital/analog converter 12. The comparator $C_3$ compares the magnitude of the measured signal $C_1$ (for example, its voltage) to the base signal $C_2$ (for example, its voltage) to determine if the concentration of the slurry supplied through the line I is less than the desired concentration.

If the measured voltage defining the signal $C_1$ is lower than the voltage defining the base signal $C_2$, then this indicates that the measured slurry concentration is less than (that is, thinner or lighter than) the desired concentration. Accordingly, the comparator $C_3$ emits an output signal which, as indicated by the dotted line, activates the relay R so as to activate and hence open the valve $V_2$ after a predetermined time has elapsed, and at the same time the valve $V_1$ is opened simultaneous with the activation of the relay R. The signal from the comparator $C_3$ is also transmitted, as indicated by the dotted line, to the motor M so as to activate same whereby abrasive particles are supplied from hopper 1 into the mixing tank 2. Since valve $V_1$ has also opened, the pump $P_2$ supplies some of the slurry from the main hopper $a_1$ into the mixing tank. The motor for the stirrer 2' is activated along with the motor M for the conveyor, and hence the abrasive particles supplied by the screw conveyor 1' are uniformly intermixed into the slurry which is supplied into the bottom of the mixing tank 2. This greatly facilitates the intermixing of the new abrasive particles into the slurry, prior to supply of the concentrated slurry into the main hopper $a_1$. After elapse of the time interval controlled by the relay R, which time permits the concentrated slurry to be properly mixed within the tank 2, the valve $V_2$ is opened so that the concentrated slurry is supplied through the outlet 3 into the main hopper $a_1$ so as to increase the concentration thereof.

The comparator $C_3$ maintains the valves $V_1$ and $V_2$ in an open condition for only predetermined time intervals, following which the valves automatically return to their closed position. Activation of the media make-up apparatus B is thus capable of supplying only a predetermined amount of abrasive media into the main hopper. The media is hence supplied to the main hopper in batches of predetermined amount so as to minimize the possibility of increasing the slurry concentration significantly beyond the desired amount.

If the comparator $C_3$ indicates that the measured voltage signal $C_1$ substantially equals or exceeds the base voltage signal $C_2$, which indicates that the actual slurry concentration equals or exceeds the desired concentration, then no signal is emitted by the comparator, and hence the valves $V_1$ and $V_2$ remain closed. To repeat the slurry concentration evaluation, the slurry contained within the vessel 4 is dumped, either automatically or manually, so that the vessel will be empty when a further slurry concentration evaluation is to be performed.

OPERATION

The basic wet blasting apparatus A operates conventionally in that, when the pump $P_1$ is activated, the slurry is withdrawn from the main hopper $a_1$ and is supplied through the main supply line I to the blasting gun $a_2$, which jets the blasting media against the workpiece. The ejected blasting media is again recollected within the main hopper $a_1$. Since the blasting media experiences breakdown through fracture and the like, some of the slurry in the hopper is sent to the hydrocyclone $a_3$ so as to effect separation of the lighter or fractured particles, the latter being discharged through line III, with the good slurry and particles being resupplied to the main hopper. This removal of lighter and fractured particles, in itself, affects the slurry concentration so that, through continued use, the slurry concentration will decrease, and hence the addition of abrasive particles to the slurry is required if the slurry concentration is to be maintained within as predetermined range.

To provide for automatic control of the slurry concentration within a predetermined range, the control device C is utilized for regulating the media make-up apparatus B. The timer T, when energized, causes the valve $V_3$ to automatically open at predetermined time intervals, with the valve $V_3$ being maintained open for only a selected time sufficient to permit filling of the vessel 4, following which the valve $V_3$ will close until the timer T again activates it at the beginning of the next time interval. The filling of the vessel 4 hence permits the load cell to generate the measured voltage signal $C_1$ which is supplied to the comparator $C_3$, and which is compared with the base signal signal $C_2$ which is predetermined and preset in the setting device $C_4$. If the signal $C_1$ is less than the signal $C_2$ so as to indicate that the slurry concentration is less than the desired magnitude, then the comparator emits electrical signals which activate the motor M, the valve $V_1$ and the relay R so that slurry is supplied from the main tank $a_1$ to the bottom of the mixing tank 2, and additional media is supplied from hopper 1 into the mixing tank 2 for addition to the slurry therein. Upon expiration of the time interval associated with the relay R, valve $V_2$ is opened and the slurry within the mixing tank, which slurry has been enriched with additional blasting media, is then supplied through outlet 3 into the main hopper $a_1$. Following expiration of preset times, the valves $V_1$ and $V_2$ close and the control system C remains inactive until the timer T again opens the valve $V_3$ so as to permit a further measurement to be made and compared to the base signal. Prior to each measuring step, the vessel 4 is emptied, preferably automatically, although this also can be accomplished manually. Emptying can be easily accomplished by utilizing a reciprocating drive device (not shown) which would be activated upon completion of the comparison step by the comparator $C_3$, such reciprocating drive device being capable of effecting pivoting of the vessel 4 so as to effect dumping thereof. Alternately, the emptying of the vessel could be accomplished through a discharge opening formed in the bottom thereof and controlled by a valve, the latter also being controllable by the comparator.

As an alternate mode of operation, rather than supplying the additional concentrated slurry from the make-up hopper to the main hopper in batches, the additional concentrated slurry could be added continuously until the desired concentration level is reached. In such instance, after the initial measuring step has been concluded and the motor M and valves $V_1$ and $V_2$ activated, then the enriched concentrated slurry from the make-up tank 2 is supplied to the hopper $a_1$. This supplying of enriched concentrated slurry continues, and the timer T is again activated to open the valve $V_3$ and again fill the vessel 4 so that a further signal $C_1$ is sent to the comparator $C_3$ and compared to the base signal $C_2$. If the signal $C_1$ now equals or exceeds the base signal $C_2$, indicating that the desired slurry concentration has been reached (if the slurry concentration is slightly greater than the desired amount, this offers no severe obstacle), then the comparator $C_3$ delivers a signal which indicates a "normal" condition, which signal stops the motor M and also closes the valves $V_1$ and $V_2$. The slurry concentration control C hence will remain inactive until the timer T again activates the valve $V_3$ so as to carry out further measuring steps.

In the arrangement of this invention, the weight of a predetermined volume of slurry is determined by the slurry collected in the vessel, which slurry is the same as the slurry being ejected from the blasting gun, so that the slurry concentration as supplied to the blasting gun can hence be correctly and accurately measured without being affected by the abrasive nature of the particles or by the flow rate of the slurry, which measurement can be accomplished using simple and accurate measuring equipment. In addition, this arrangement permits the concentration of the slurry as sent to the main slurry supply line to be kept within a predetermined allowable range by comparing the measured value to a preset value in the comparator circuit. This system permits consistent and repeatable blasting operations to be assured.

Since the surface of various abrasive particles do not have sufficient wettability, this often creates a problem when adding additional blasting media to the slurry. Particles such as artificial abrasive particles, alumina and silicate tend to take a few seconds to sufficiently wet so as to uniformly mix with water. Further, if the particle size of the abrasive is very fine, for example its mean diameter is less than 0.05 mm or mesh size No. 120, the ratio of surface area of particle increases compared with its weight, and the particle tends to float on the water. In the case of particles of synthetic resin, they are initially hydroscopic in nature. They do not have sufficient affinity with water, and hence a surfactant is added so as to give them greater affinity with water. In this invention, however, the abrasive particles are first brought into contact with slurry within the auxiliary mixing tank 2 so as to provide an opportunity for the abrasive particles to become sufficiently wetted and uniformly mixed with the slurry prior to the enriched slurry then being added to the slurry contained within the main hopper $a_1$. This hence provides much more uniform mixing of the slurry and, in particular, greatly facilitates the addition of further abrasive particles to the slurry within the main hopper so as to increase the concentration thereof.

MODIFICATION

Figure 3:
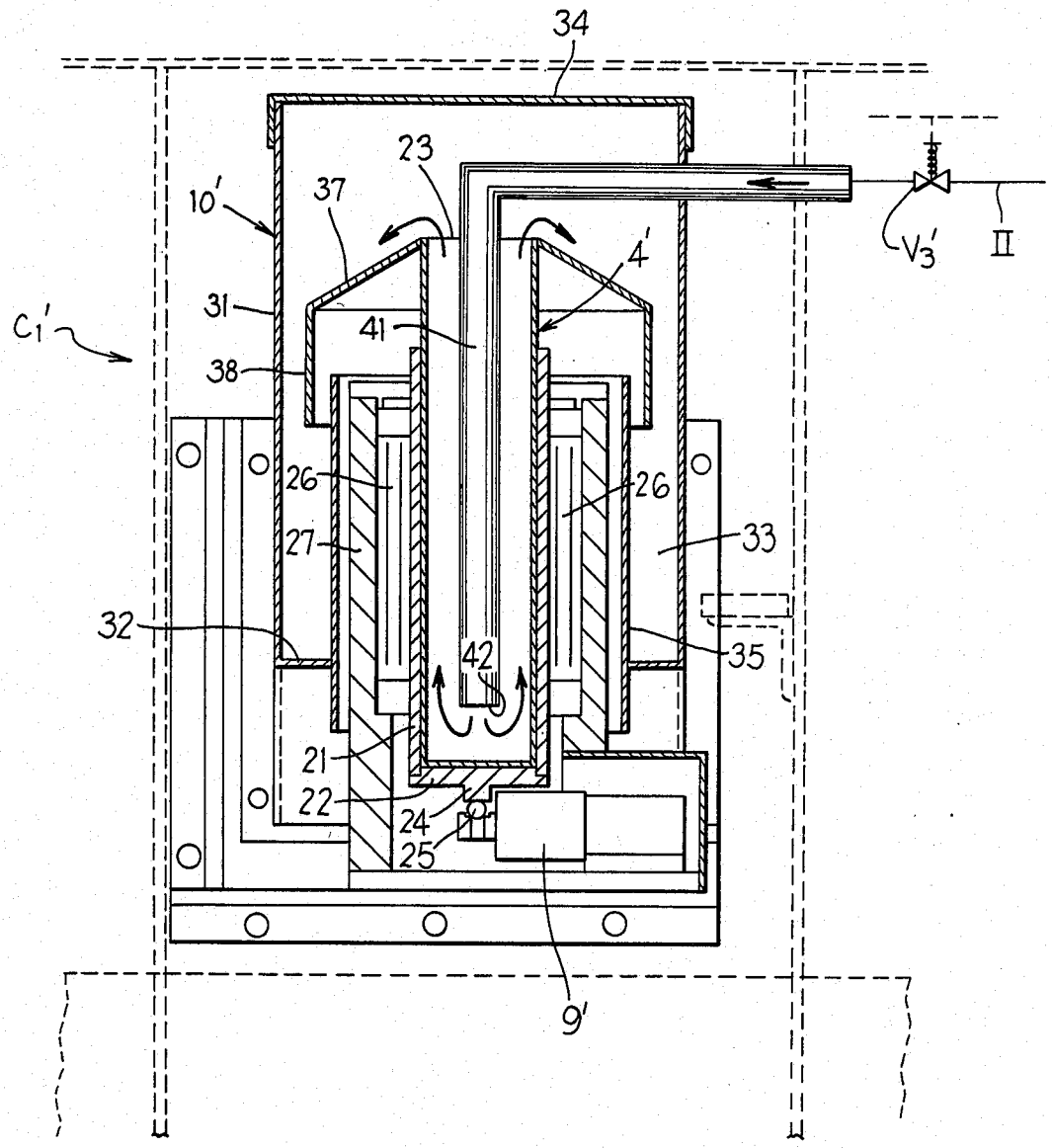
FIG. 3 is a fragmentary cross-sectional view of a preferred variation of the slurry weight measuring means for use in conjunction with the control device of FIG. 1.
Figure 4:
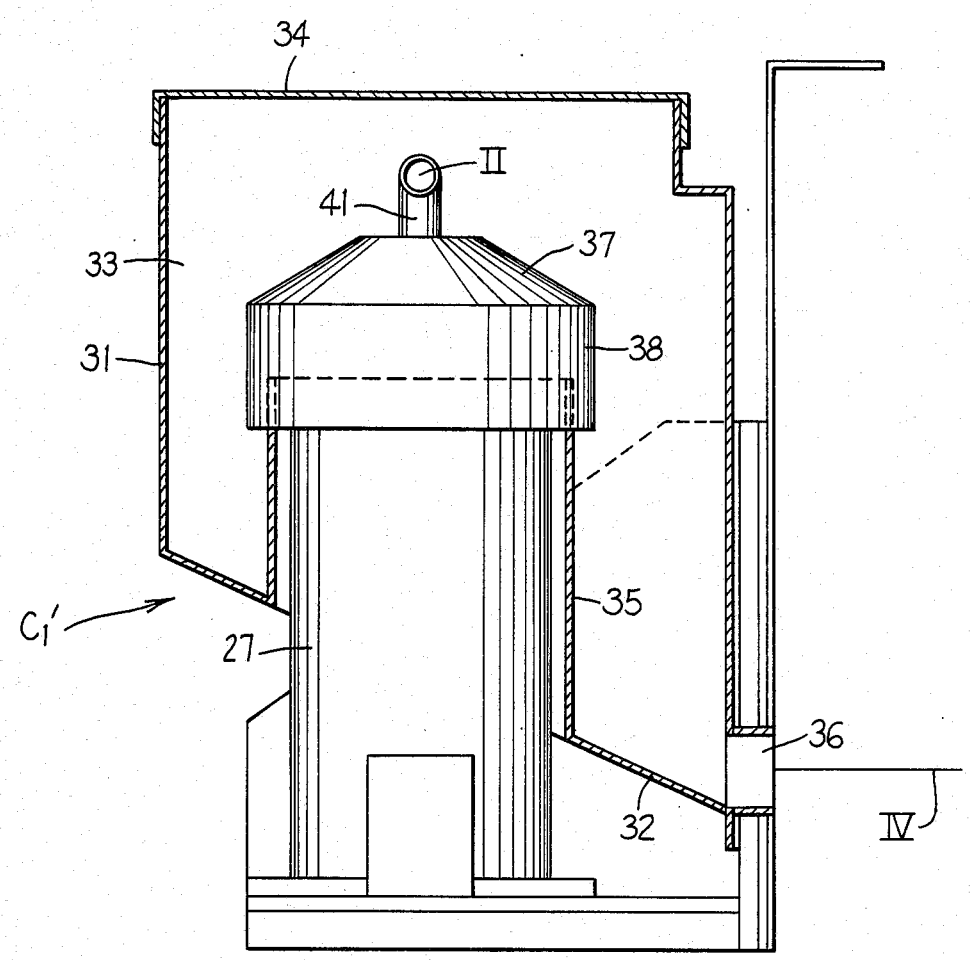
FIG. 4 is a side view of the arrangement illustrated in FIG. 3.

Referring to FIGS. 3 and 4, there is illustrated a variation of the slurry weight measuring means which is usable within the system illustrated by FIG. 1. More specifically, the modified slurry weight measuring means $C_1'$ of FIGS. 3 and 4 is substituted for the weight measuring means $C_1$ of FIG. 1.

The slurry weight measuring means $C_1'$ includes a measuring vessel 4' in which the slurry is collected. This vessel is of an upwardly opening cylindrical shape and includes a substantially cylindrical sidewall 21 having a closed bottom wall 22, the vessel projecting upwardly and having an open upper end 23. The bottom wall 22 of the vessel has a downward central projection 24 which bears on a bearing element formed as a ball 25, which bearing element is associated with a conventional load cell 9'. This load cell 9', in a conventional manner, emits an electrical signal which is indicative of the weight of the slurry contained within the interior of the vessel 4', with this signal being transmitted to the amplifier 11 of FIG. 1.

The vessel 4' is effectively disposed within a collection housing 10'. This collection housing 10' includes an upright tubular sidewall structure 31 which is closed at its lower end by a sloped or tapered bottom wall 32 so that the housing 10' defines a chamber 33 therein for receiving the slurry which overflows the vessel 4 through the open upper end 23 thereof. The upper end of this collection housing 10' is preferably closed by a removable cover 34. Housing 10' also has an inner annular shroud or wall 35 which is fixed to and projects upwardly from the bottom wall 32 in surrounding relationship to the vessel 4'. This wall 35 in particular surrounds a stationary support 27 which concentrically surrounds the vessel 4', the vessel 4' being supported on the support 27 through conventional intermediate linear ball bearing guides 26 so as to permit the vessel 26 to have a limited vertical displacement as required by the weight of the slurry therein and the weight as transmitted to the load cell.

The interior chamber 33 defined by the collection housing 10' has a discharge opening 36 at the lowermost point thereof, which opening communicates with the line IV for returning the slurry to the main tank $a_1$ of FIG. 1.

The slurry is fed into the vessel 4' through the bleed line II, which bleed line has the valve $V_3'$ associated therewith, this valve being normally open (in contrast to the normally closed valve $V_3$ of FIG. 1). This bleed line II, at its discharge end, terminates in a downwardly extending pipe portion 41 which projects concentrically downwardly into the interior of the vessel 4' so that the lower discharge end 42 is directed downwardly toward but spaced upwardly a small distance above the bottom wall 22. The valve $V_3'$ is normally electrically or magnetically actuated and is coupled to a timer (such as the timer T of FIG. 1) for closing the valve for only a predetermined period of time, with the valve otherwise normally being maintained in its open position.

During operation of this modified system, that is, during operation of the system illustrated by FIG. 1 as modified to incorporate the slurry weight measuring means $C_1'$ of FIGS. 3 and 4, the valve $V_3'$ is normally opened so that slurry is continuously bled through the line II and discharged from pipe 41 into the vessel 4'. The vessel is normally filled with slurry, whereupon the slurry overflows the open upper end 23 into the surrounding collection chamber 33, and thence is returned through line IV to the main slurry tank. Since the discharge pipe 41 has the lower end 42 thereof directed downwardly toward and spaced only a small distance above the bottom wall 22, the discharge jet from the end 42 and the almost immediate upward flow of slurry around the outside of the pipe 41 causes substantial agitation of the slurry within the vessel 4', and hence prevents the suspended particles from depositing in the bottom of the vessel. Rather, the slurry within the vessel remains sufficiently agitated to maintain a concentration which corresponds to the concentration of the slurry being fed into the vessel through the bleed line II. Hence, as the concentration in the bleed line II varies, the concentration in the vessel 4' will likewise vary.

When the slurry concentration is to be measured, the timer T is activated, and it emits a signal which causes closing of the valve $V_3'$ for a predetermined time interval. This closing of the valve $V_3'$ terminates the flow of slurry into the vessel 4', whereupon the vessel is effectively filled with slurry and the impact forces which would be imposed thereon due to the downward discharge of slurry are hence eliminated. During this time interval when valve $V_3'$ is closed, the timer also emits a signal which activates the load cell 9' so that it measures the weight of the vessel and of the slurry therein, the slurry being a predetermined volume, namely the volume required to fill the vessel. The load cell 9' then emits an electrical signal to the amplifier 11, which signal represents the weight being measured, namely the weight of the slurry within the vessel 4'. This signal as transmitted to the amplifier 11 is then compared in the same manner as explained above relative to FIG. 1.

After expiration of the predetermined time interval, the valve $V_3'$ returns to its normally open position and slurry is again bled through the line II into the vessel in a continuous manner until the timer T is again activated so as to initiate a subsequent measuring step. The timer T can be activated in a sequential time sequence if desired so as to permit sequential measuring steps at selected intervals.

With this arrangement, a continuous flow of slurry is effectively supplied into and through the measuring vessel 4', with this flow being interrupted only momentarily so as to permit a weight measuring signal to be generated. The process can effectively be carried out in a continuous manner without requiring any emptying or dumping of the vessel, and at the same time the concentration of the slurry within the vessel during the measuring cycle accurately represents the concentration of slurry being supplied to the blasting gun.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A wet blasting machine with automatic control for slurry concentration, comprising:

a wet blasting apparatus having a main hopper containing slurry therein, a blasting gun for ejecting the slurry against a workpiece, and a supply circuit including therein a pump for transporting the slurry from the main hopper to the gun, the slurry discharged from the gun being resupplied to the main hopper;

a blasting media supply device for supplying additional blasting media to the main hopper, said supply device including a make-up hopper having a stirring device associated therewith, a media hopper containing therein blasting media, a motor-driven conveyor for supplying media from the media hopper to the make-up hopper, and a slurry recirculating circuit for supplying slurry from the main hopper to the make-up hopper, said slurry recirculating circuit including a pump therein and also including a first valve means; and slurry concentration control means for measuring the concentration of the slurry in the supply circuit and for controlling addition of media to the main hopper so as to maintain the slurry concentration in the supply circuit within a predetermined range, said control device including:

second normally closed valve means associated with the outlet line which connects the mixing hopper with the main hopper, vessel means for holding a given volume of slurry, a bleed circuit connected between said supply circuit and said vessel means for bleeding slurry into said vessel means for filling it with slurry, the bleed circuit having third timer-controlled valve means associated therewith, weight measurement means associated with said vessel means for determining the weight of the slurry in the vessel means and for generating a first signal which is representative of said weight, means for generating a second preset signal which represents the preset desired slurry concentration, comparator means for comparing said first and second signals and for generating an output signal if the comparison indicates that the second signal represents a heavier slurry concentration than said first signal, said output signal activating said first and second valve means.

2. A machine according to claim 1, wherein said second valve means has a delay timer associated therewith so that the second valve means is opened a predetermined time after receiving the output signal from said comparator.

3. A wet blasting machine for blasting a slurry comprising a mixture of liquid and abrasive media against a workpiece, said machine including a main hopper containing slurry therein, a blasting gun for ejecting slurry against a workpiece, and supply conduit means for supplying slurry from said main hopper to said blasting gun, said supply conduit means having pump means associated therewith, the improvement comprising:

means for supplying additional blasting media to said main hopper to increase the concentration of the slurry, said means including a mixing hopper, a diverter circuit having a pump associated therewith for permitting some of the slurry in said main hopper to be supplied to said mixing hopper, and a media hopper for selectively supplying additional media into said mixing hopper, said mixing hopper having an outlet for communication with said main hopper;

means for measuring the concentration of the slurry in the main hopper including vessel means for holding a predetermined volume of slurry therein, a bleed circuit connecting between said vessel means and said supply conduit means for permitting slurry to be supplied to said vessel means for filling it, and means associated with said vessel means for measuring the weight thereof and for generating a first signal which is indicative of said weight;

control means for evaluating said first signal and for activating the media supplying means if the slurry concentration is less than a predetermined range, said control means including comparator means for comparing said first signal to a second preset signal which represents the desired slurry concentration and for generating an output signal which activates the media supplying means if said first signal differs from said second signal so as to indicate that the slurry concentration in the main hopper is less than the desired concentration.

4. A machine according to claim 3, wherein said control means includes a first normally closed valve means associated with said diverting circuit, said first valve means being activated and opened by said output signal to permit slurry to be supplied to said mixing hopper; and said control means also including a second normally closed valve means associated with said outlet, said second valve means being activated by said output signal.

5. A machine according to claim 4, wherein said second valve means has a timer associated therewith for delaying the opening of said second valve means following activation thereof by said output signal.

6. A machine according to claim 4, wherein said output signal also activates a motor associated with a conveyor for delivering media from said media hopper to said mixing hopper.

7. A machine according to claim 4, wherein said bleed circuit has a third valve means associated therewith.

8. A machine according to claim 3, wherein said bleed circuit has valve means associated therewith for controlling flow of slurry into said vessel means.

9. A machine according to claim 8, wherein said valve means is normally maintained in an open position to permit substantially continuous flow of slurry through said bleed line into said vessel means so as to substantially maintain said vessel means full of slurry, timer means associated with said valve means for closing said valve means for a short predetermined time interval when the weight of the slurry in the vessel means is to be measured, said timer means when activated also causing activation of the weight measuring means.

10. A machine according to claim 9, wherein said vessel means comprises a substantially cylindrical upright vessel which is closed at its bottom end and open at its upper end, said bleed line including a discharge pipe which projects concentrically downwardly into said vessel and terminates at its lower end in a discharge opening which is positioned directly opposite but spaced upwardly a small distance from the bottom wall of said vessel so that continuous discharge of slurry from said bleed line into said vessel maintains the slurry within the vessel agitated as to be representative of the concentration of the slurry as supplied through the bleed line.

11. A machine according to claim 10, wherein said vessel is guidably disposed for limited vertical displacement and is vertically supported on said weight measuring means.

12. In a wet blasting machine for blasting a slurry comprising a mixture of liquid and abrasive media against a workpiece, said machine including a main hopper containing slurry therein, a blasting gun for ejecting slurry against a workpiece, and supply conduit means for supplying slurry from said main hopper to said blasting gun, the improvement comprising:

means for measuring the concentration of the slurry fed from the main hopper to the blasting gun, said concentration measuring means including vessel means for holding a predetermined volume of slurry therein, a bleed circuit connected between said vessel means and said supply conduit means for permitting slurry to be supplied to said vessel means for filling it, and means associated with said vessel means for measuring the weight thereof and for generating a first signal which is indicative of said weight;

control means for evaluating said first signal and comparing it against a second predetermined signal which represents the desired slurry concentration and for generating an output signal if said first signal differs from said second signal so as to indicate that the slurry concentration is less than the desired concentration; and means responsive to said output signal for supplying additional blasting media to said main hopper to increase the concentration of the slurry therein.

13. A machine according to claim 12, wherein said vessel means includes a substantially cylindrical vessel which is disposed in an upright condition and has a substantially closed bottom wall and a substantially open top, said bleed line having a discharge pipe which projects vertically and concentrically downwardly into said upright vessel and terminates in a downwardly directed discharge opening which is disposed adjacent but spaced upwardly a small distance above the bottom wall, normally-open valve means associated with said bleed line for normally permitting continuous flow of slurry through said bleed line into said upright vessel, a weight measuring means supportingly associated with said vessel, and means for at least temporarily closing said valve means for terminating flow of slurry into said vessel and for activating said weight measuring means to measure the weight of the slurry within said vessel.

* * * * *